United States Patent [19]

Dreger

[11] 4,078,370

[45] Mar. 14, 1978

[54] ROTOR FOR OPEN-END SPINNING

[75] Inventor: Klaus-Dieter Dreger, Bremen, Germany

[73] Assignee: Fried. Krupp Gesellschaft mit beschrankter Haftung, Essen, Germany

[21] Appl. No.: 737,103

[22] Filed: Oct. 29, 1976

[30] Foreign Application Priority Data

Nov. 13, 1975 Germany ..... 2550971

[51] Int. Cl.[2] ..... D01H 11/00; D01H 1/12

[52] U.S. Cl. ..... 57/56; 57/58.89

[58] Field of Search ..... 57/58.89–58.95, 57/56

[56] References Cited

U.S. PATENT DOCUMENTS

| | | | |
|---|---|---|---|
| 3,604,194 | 9/1971 | Edagawa et al. | 57/58.89 |
| 3,605,395 | 9/1971 | Morikawa et al. | 57/58.89 |
| 3,774,386 | 11/1973 | Kutscher et al. | 57/58.95 |
| 3,812,667 | 5/1974 | Marsalak et al. | 57/58.89 |
| 3,952,493 | 4/1976 | Khomyakov et al. | 57/58.89 |

*Primary Examiner*—John Petrakes
*Attorney, Agent, or Firm*—Spencer & Kaye

[57] ABSTRACT

In a spinning rotor for an open-end spinning unit, the rotor being provided with a bore extending along its axis of rotation to accommodate a yarn extraction tube and being formed to define a fiber collection trough and an intake portion whose cross section widens in the direction toward the trough, the intake portion presenting a radially outwardly extending projecting portion which merges into and defines one boundary of the fiber collecting trough, the region where the projecting portion merges with the trough constituting the region of maximum diameter of the trough and the side of the trough opposite the projecting portion being defined by the spinning rotor bottom surface, the fiber collection trough is kept clean by forming the collection trough so that the radially outermost end of the surface of the projecting portion defines the maximum diameter of the trough, imparting to the portion of the trough adjacent the rotor bottom surface a configuration such that the diameter of the trough in this region is less than the maximum diameter, locating the projecting portion so that the axial distance between the rotor bottom surface and the radially innermost end of the projecting portion is between 1/16 and 1/6 of the maximum diameter of the fiber collecting trough, and providing the outer periphery of the rotor with cleaning bores whose inlet ends communicate with the rotor interior and are disposed in the region of the radially outermost end of the projecting portion.

4 Claims, 3 Drawing Figures

ROTOR FOR OPEN-END SPINNING

BACKGROUND OF THE INVENTION

The present invention relates to a spinning rotor for an open-end spinning unit of the type having an intake portion whose cross section widens in the direction toward the fiber collecting trough and presents a stepped, or outwardly projecting, section which merges into and defines one boundary of the fiber collecting trough and which increases the diameter of the rotor. The side of the fiber collecting trough which is opposite the stepped section is defined by the bottom surface of the spinning rotor.

In a rotor of this type, the radially outermost end of the stepped section defines the maximum diameter of the fiber collecting trough, and the trough portion following that outermost end, i.e. between that end and the rotor bottom surface, has, at least in the area of transition between the trough and the spinning rotor bottom surface, a smaller diameter. In addition, the axial distance between the projection of the bottom surface and the radial innermost end of the stepped section is between 1/16 and 1/6 of the largest diameter of the fiber collecting trough. This axial distance is measured from the intersection of the projection of the rotor bottom surface on a cylinder centered on the rotor axis and passing through the radially outermost end of the stepped section surface. Such a structure is disclosed in commonly assigned copending U.S. application Ser. No. 700,125, filed by Rolf Neubert and Rolf Wehling on June 28th, 1976.

A spinning structure is known in which the fiber collecting trough has a cross section which becomes wider in the direction toward the bottom surface of the spinning rotor. In the area of the bottom surface of the spinning rotor the fiber collecting trough is limited by a further stepped section which constitutes part of the spinning rotor bottom surface, and in the latter stepped section there are provided air bores whose longitudinal axes are perpendicular to the rotor axis.

The drawback of this known spinning structure is, in particular, that the widening cross section of the fiber collecting trough in the direction toward the bottom surface of the spinning rotor, facilitates depositing of impurities in the fiber collecting trough and, moreover, no means are provided to permit removal of impurities from the fiber collecting trough. The interior entrance cross sections of the air bores are disposed at a significantly smaller diameter, i.e. closer to the rotor axis, than is the fiber collecting trough and the section before it. Consequently, they are not intended for cleaning of the fiber collecting trough and are not suited for this purpose.

It has been proposed to promote cleaning of the spinning rotors of open-end spinning machines by providing protrusions on the fiber collecting trough, at least on one side thereof, which protrusions are separated from one another by gaps.

According to another known arrangement, air bores are provided outside of the fiber collecting trough in the intake portion, or in the spinning rotor bottom surface opposite the intake portion.

In the units which have protrusions, it is not possible to dependably prevent fibers from being ejected together with the impurities to be removed.

The arrangements which have air bores in the intake portion or in the bottom surface of the spinning rotor have the drawback that the available air bores are hardly suitable for the removal of impurities from the fiber collecting trough, and thus from the spinning rotor. Moreover, there exists the danger, in these arrangements, that the air bores may become clogged, particularly with fiber material, during operation.

SUMMARY OF THE INVENTION

It is an object of the present invention to maintain the interior of such a stepped rotor clean, particularly in the fiber collecting trough, by suitable removal of any impurities reaching the spinning rotor.

This and other objects are accomplished by providing cleaning bores around the periphery of the spinning rotor and arranging the bores to each have an entrance cross section bordering the interior of the spinning rotor and lying in the area of the radially outermost end of the stepped section defining the maximum trough diameter.

In a spinning rotor of the above-described type, the yarn in not formed in the area of the stepped section but in the transition region adjacent the spinning rotor bottom surface, this transition region preferably having an arcuate form. It is thus possible, without adversely influencing the yarn formation process, to provide cleaning bores in the area of the stepped section, i.e. outside the area of the yarn formation zone, through which bores impurities which may possibly have reached the fiber collecting trough can be removed.

The present invention is thus based on the concept, on the one hand, of relocating the yarn formation zone in the transition region adjacent the spinning rotor bottom surface by suitably designing the spinning rotor interior and, on the other hand, of providing cleaning bores outside the region of the yarn formation zone to enable the spinning rotor to be cleaned without adversely influencing the yarn formation process.

The cleaning bores are preferably arranged so that the impurities to be removed can be removed without any impediments, i.e. without having to overcome protrusions of any kind. The cleaning bores may be disposed either directly in the stepped section or immediately adjacent to the outermost end of the stepped section.

According to embodiments of the invention, the axis of each cleaning bore lies in a common plane with the rotor axis and is inclined with respect to the rotor axis by an angle of more than 20°.

According to one preferred embodiment of the invention, the spinning rotor bottom surface is additionally provided with suction bores outside of the transition region between the trough and the rotor bottom surface.

DESCRIPTION OF THE PREFERRED EMBODIMENTS

Figure 1:
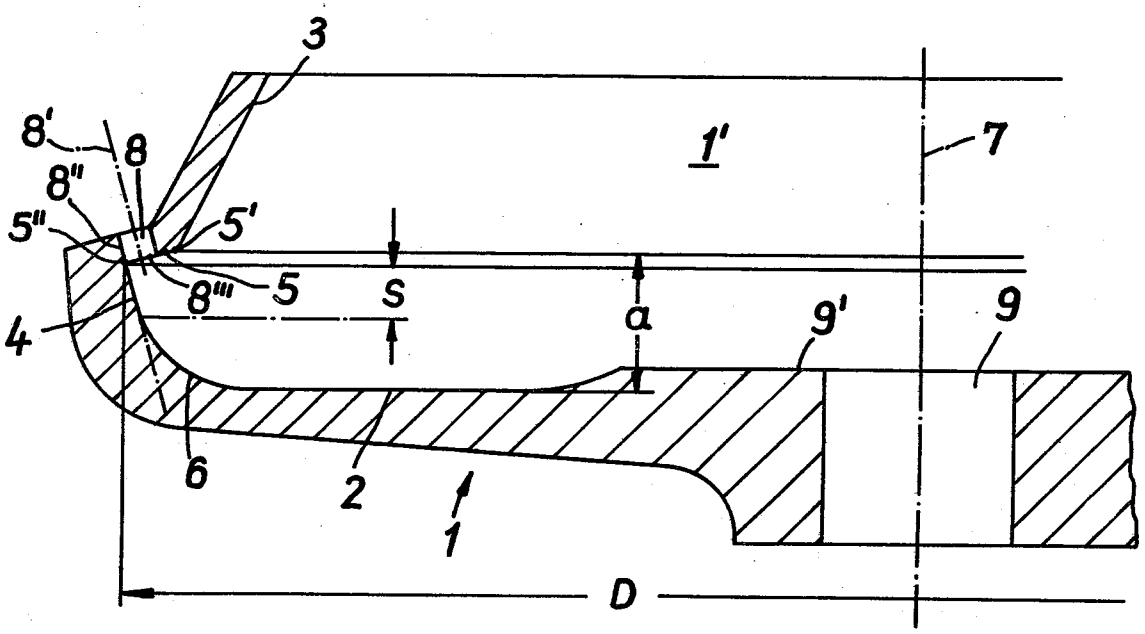
FIG. 1 is a partial, longitudinal cross-sectional view of one embodiment of a spinning rotor according to the invention with cleaning bores disposed in the stepped section and oriented in a direction oblique to the rotor axis.

In the unit shown in FIG. 1, a spinning rotor 1 has a conical intake portion surface 3 which widens in the direction toward the bottom surface 2 of the spinning rotor and along which broken-up fiber material to be processed is fed to the fiber collecting trough 4. While the intake portion surface 3 here has the form of a conical surface, it could also be curved in the plane of the drawing. For example, surface 3 could have the form of a section of a spheroid.

The intake portion 3 is followed by a stepped section presenting a radially outwardly projecting surface 5 which serves to increase the rotor diameter. The radially innermost end 5' of surface 5 is simultaneously the end of the intake portion surface 3. The radially outermost end 5" of the stepped section surface 5 defines the maximum diameter D of the fiber collecting trough 4. The trough diameter decreases in the direction toward the bottom surface 2 of the spinning rotor, or at least has a diameter in the transition region 6 where the trough merges into the bottom surface 2 of the spinning rotor which is smaller than the maximum diameter D formed by the radially outermost end 5" of the stepped section.

The collecting trough surface region *s* immediately following the end 5" of the stepped section surface may be cylindrical (not shown) or conical as shown in FIG. 1.

The stepped section surface 5 shown in FIG. 1 is inclined to the rotor axis 7, i.e. the ends 5' and 5" of the stepped section surface 5 lie in respectively different planes perpendicular to the rotor axis 7.

According to the present invention, cleaning bores 8 are provided in the stepped section 5 and axes 8' of bores 8 are inclined with respect to the rotor axis 7. Advantageously, each cleaning bore 8 is arranged in the stepped section so that the radially outermost linear generatrix 8" of its cylindrical surface starts at the outer end 5" of the stepped section. In other words, the point on the inlet of bore 8 which is furthest from rotor axis 7 lies at end 5". The inlet opening cross section 8"' of each cleaning bore 8 within the interior 1' of the spinning rotor is therefore arranged so that, as required, impurities reaching the fiber collecting trough 4 can be discharged toward the outside without impediment.

The spinning rotor bottom surface 2 preferably merges into a frontal surface 9' in the area of the rotor exit bore 9 via which the finished yarn is removed by means of a yarn extraction tube (not shown) located in bore 9.

The axial distance *a* between the bottom surface 2, which is in the illustrated embodiments perpendicular to the rotor axis 7, and the radially innermost end 5' of stepped section surface 5 is, for example, 1/10 of the maximum diameter D of the rotor interior.

According to a modification of the embodiment shown in FIG. 1, the bottom surface 2 of the rotor may be oblique with respect to the rotor axis 7, when seen in cross section, i.e. the bottom surface 2 may have a conical form. In this case the distance *a* is the axial distance between the end 5' and the projection of the bottom surface 2 on a cylinder coaxial with axis 7 and containing the radially outermost end 5" of surface 5.

Figure 2:
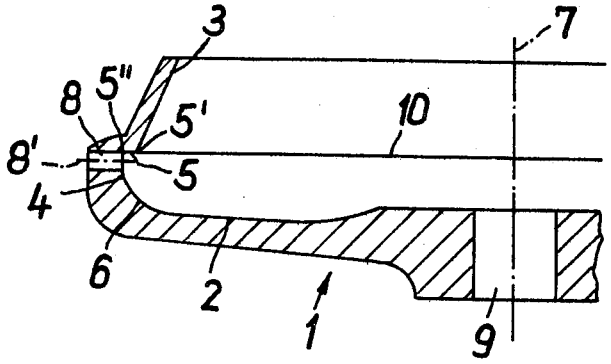
FIG. 2 is a view similar to that of FIG. 1 of an embodiment of the invention with cleaning bores arranged directly next to the outer end of the stepped section.

In the embodiment shown in FIG. 2, surface 5 is perpendicular to the rotor axis 7, i.e. the ends 5' and 5" of the stepped section surface 5 both lie in a common plane which is perpendicular to the rotor axis 7.

The embodiment shown in FIG. 2 differs from that of FIG. 1 in that the cleaning bores are not disposed in the stepped section itself, but are rather located immediately adjacent thereto, in the lateral wall of trough 4. The edge of the inlet end of each bore 8 which is nearest the stepped section here starts from the outer end 5" of the stepped section. Thus, these edges of all of the bores 8 constitute an extension of the plane 10 passing through ends 5' and 5" and extending perpendicular to the rotor axis 7.

The axes 8' of bores 8 are shown to be perpendicular to axis 7 and may have this perpendicular orientation even if stepped section surface 5 has a conical form, i.e. if the ends 5' and 5" do not both lie in the perpendicular plane 10 and are arranged as shown in FIG. 1.

Figure 3:
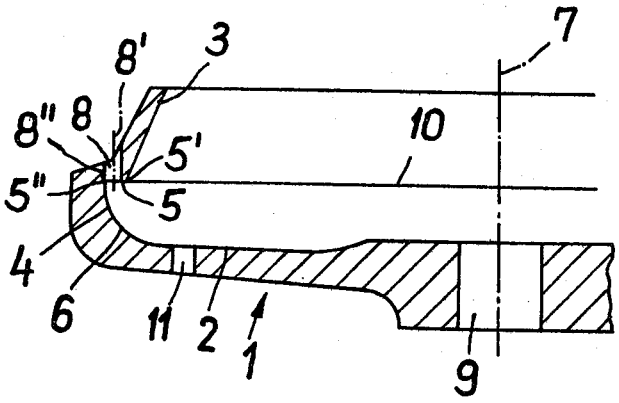
FIG. 3 is a view similar to that of FIG. 1 of an embodiment of the invention having suction bores arranged in the bottom surface of the spinning rotor, outside of the transition region, and cleaning bores arranged in the stepped section with their axes parallel to the rotor axis.

In the embodiment shown in FIG. 3, the stepped section surface 5 is arranged as a radial surface, i.e. perpendicular to axis 7 corresponding to the embodiment of FIG. 2, and the cleaning bores 8 are formed in the stepped section with their axes 8' parallel to the rotor axis 7.

The axes 8' of bores 8 are here disposed on a diameter which is at least large enough that the radially outermost linear generatrix 8" of each bore passes through the radially outermost end 5" of the stepped section surface 5 and practically forms an unstepped continuation of the fiber collecting trough 4.

The spinning rotor of FIG. 3 is additionally provided with suction bores 11 which are arranged in the bottom surface 2 outside of the transition region 6 where the fiber collecting trough 4 merges into the bottom surface 2.

The embodiments shown in FIGS. 1 and 2 may similarly be additionally provided with suction bores 11.

In any case, however, the cleaning bores 8 are disposed on the periphery of the spinning rotor in such a manner that they do not adversely influence the formation of the yarn in the transition region 6, i.e. they are either arranged in the stepped section itself or follow immediately thereafter.

In practical operative embodiments of the invention, the angle of inclination of intake surface 3 with respect to axis 7 dcan be between 10° and 40°, while the inclination of surface 5 relative to axis 7 can be between 60° and 90°. The radius of curvature of the surface of transition region 6 is preferably D/10, but can vary between D/20 and D/3, while the maximum diameter D could, to cite one typical example, have a value of 130 mm. On the periphery of the spinning rotor may be disposed eight cleaning bores 8 each being about 3 mm in diameter.

It will be understood that the above description of the present invention is susceptible to various modifications, changes and adaptations, and the same are intended to be comprehended within the meaning and range of equivalents of the appended claims.

What is claimed is:

1. In a spinning rotor for an open-end spinning unit, the rotor defining a fiber collecting trough and an intake portion whose cross section widens in the direction toward the fiber collecting trough, the intake portion being formed and disposed to provide a radially outwardly extending projecting portion presenting a surface which merges into and defines one boundary of the fiber collecting trough and which presents a region in which the rotor diameter is increased, the boundary of the fiber collecting trough opposite the projecting portion being defined by the spinning rotor bottom surface, the radially outermost end of the surface of the projecting portion defining the maximum diameter of the fiber collecting trough; a portion of the trough between the outermost end of the projecting portion surface and the rotor bottom surface, and adjacent the rotor bottom surface, presenting a region in which the diameter of the trough is less than such maximum diameter, and the axial distance between the projection of the rotor bottom surface and the radially innermost end of the projecting portion surface, measured at a level of the outermost end of the projecting portion surface, being between 1/16 and 1/6 of the maximum diameter of the fiber collecting trough, the improvement wherein said rotor is provided at its outer periphery with cleaning bores whose inlet ends communicate with the interior of said rotor and are formed in said projecting portion surface.

2. An arrangement as defined in claim 1 wherein said cleaning bores are so located that the radially outermost point of their inlet ends is located at the radially outermost end of said projecting portion.

3. An arrangement as defined in claim 1 wherein the longitudinal axis of each said cleaning bore lies in a common plane with the axis of said rotor and is inclined with respect to the rotor axis by an angle of greater than 20°.

4. An arrangement as defined in claim 1 wherein said spinning rotor bottom surface is additionally provided with suction bores located outside of the region of said collecting trough.

* * * * *